US005967846A

United States Patent [19]

Davis et al.

[11] Patent Number: 5,967,846

[45] Date of Patent: Oct. 19, 1999

[54] SHIELDS FOR ELECTRICAL CONNECTOR MATED PAIR

[75] Inventors: Wayne Samuel Davis; Earl Chester Myers, Jr., both of Harrisburg; Robert Neil Whiteman, Jr., Middletown, all of Pa.

[73] Assignee: The Whitaker Corporation, Wilmington, Del.

[21] Appl. No.: 09/039,152

[22] Filed: Mar. 13, 1998

Related U.S. Application Data

[60] Provisional application No. 60/044,584, Apr. 22, 1997.

[51] Int. Cl.[6] ..... H01R 13/648

[52] U.S. Cl. ..... 439/609; 439/567

[58] Field of Search ..... 439/79, 92, 108, 439/567, 607–609

[56] References Cited

U.S. PATENT DOCUMENTS

| | | | |
|---|---|---|---|
| 4,806,107 | 2/1989 | Arnold et al. | 439/79 |
| 5,035,652 | 7/1991 | Shibano | 439/610 |
| 5,055,069 | 10/1991 | Townsend et al. | 439/608 |

FOREIGN PATENT DOCUMENTS

| | | | |
|---|---|---|---|
| 3834182 A1 | 4/1990 | Germany | H01R 13/648 |
| 4004385 A1 | 8/1990 | Germany | H01R 13/648 |

OTHER PUBLICATIONS

International Search Report in corresponding PCT/US98/08043 mailed 98 Apr. 8, 1998; 2 pages.

*Primary Examiner*—Khiem Nguyen
*Attorney, Agent, or Firm*—Anton P. Ness

[57] ABSTRACT

Matable board-mount connectors (10,110) including add-on shields (40,140) that are adapted to groundingly engage during connector mating. Shields (40,140) have top walls (44,144), side walls (46,146), rear wall portions (52,152), retention sections (48,148) and integral boardlocks (50,150). Mating portion (142) of shield (140) is adapted to surround mating portion (42) of shield (40) and includes resilient sections (170,146) that assuredly engage shield (40) and be deflectable thereby, maintaining spring bias thereagainst in the mated connector condition.

7 Claims, 5 Drawing Sheets

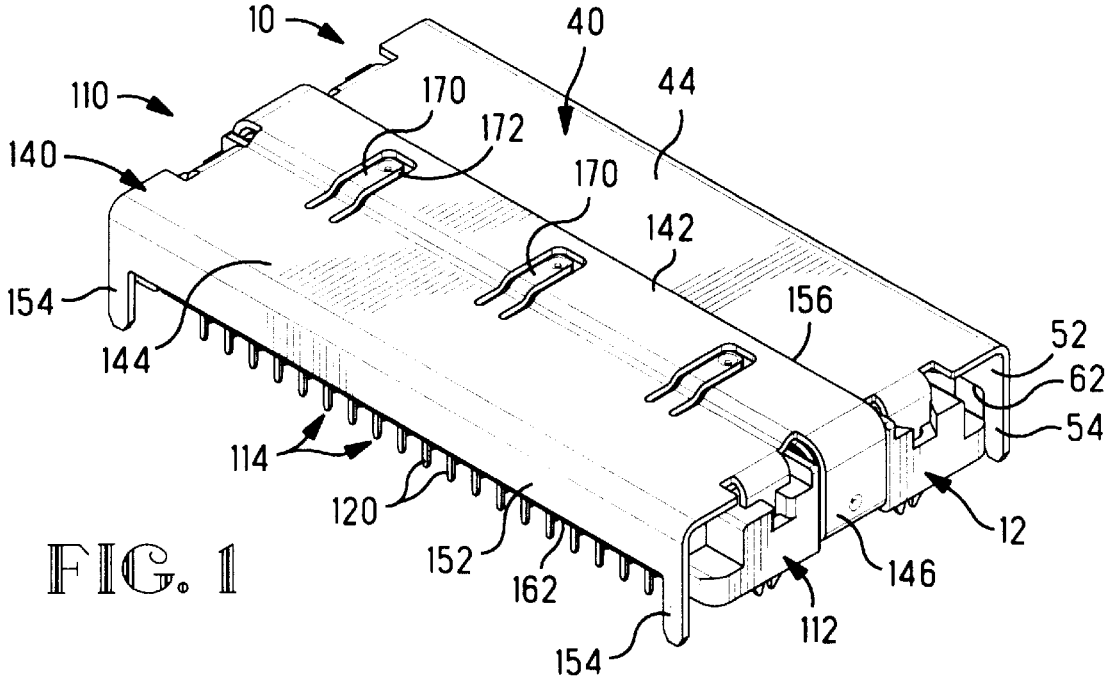
FIG. 1
FIG. 2
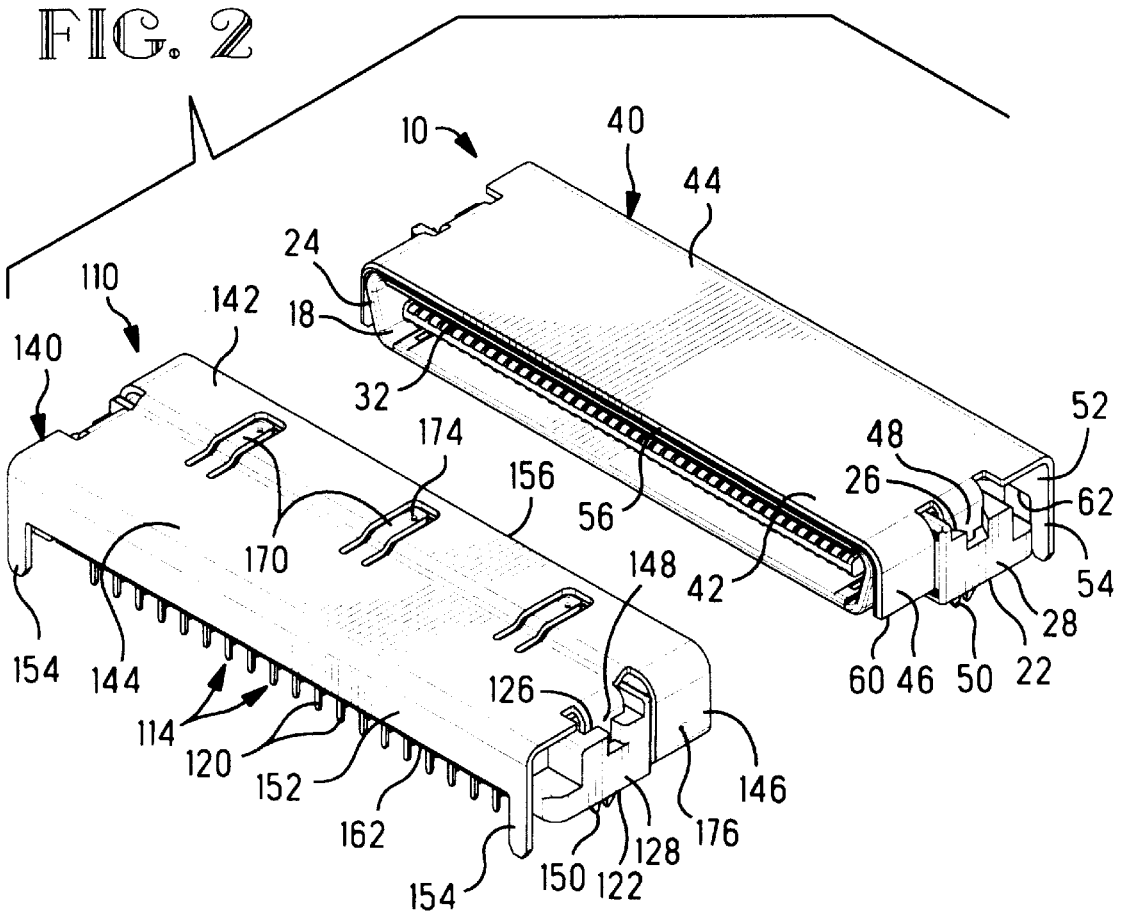

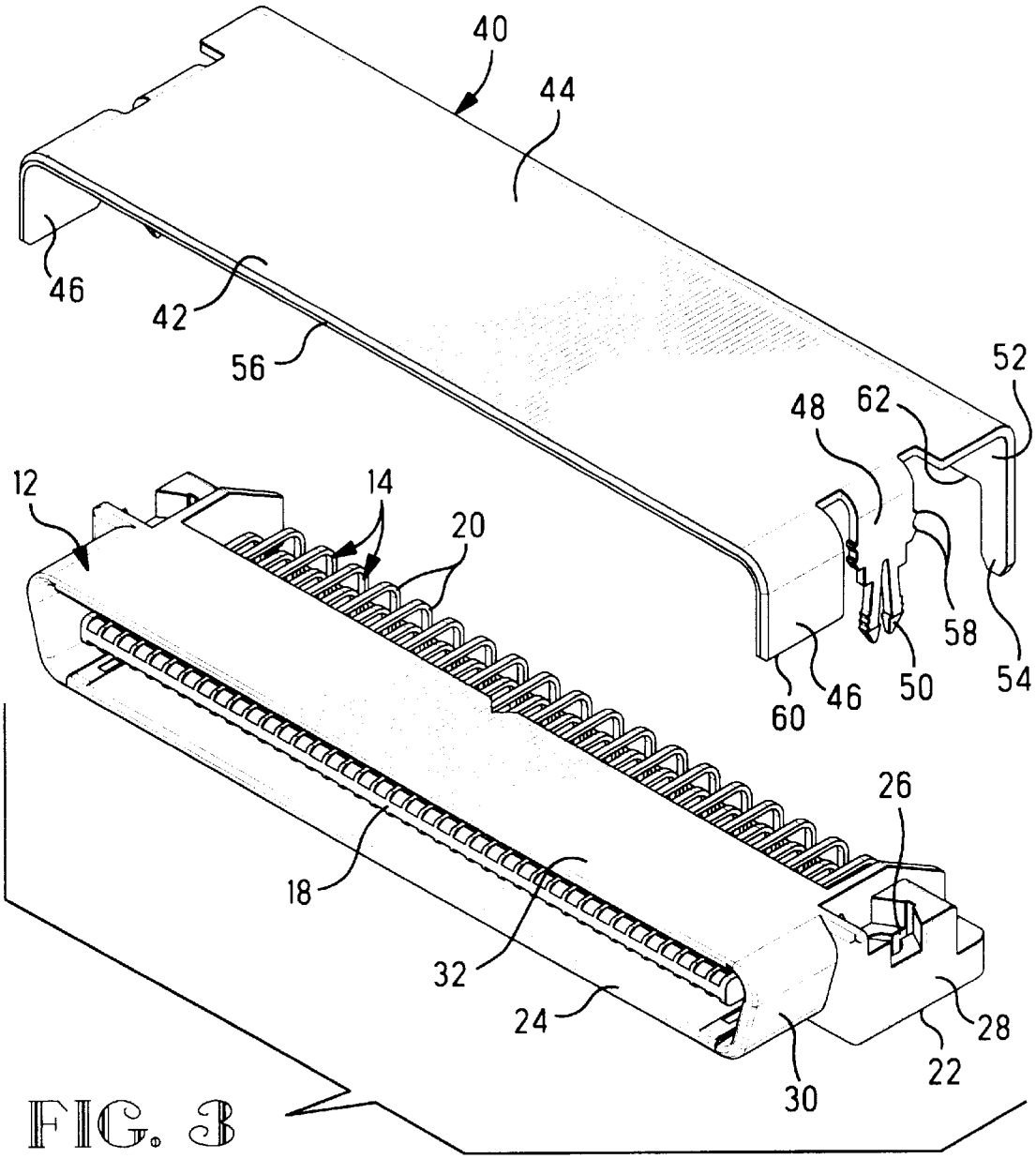
FIG. 3
FIG. 4
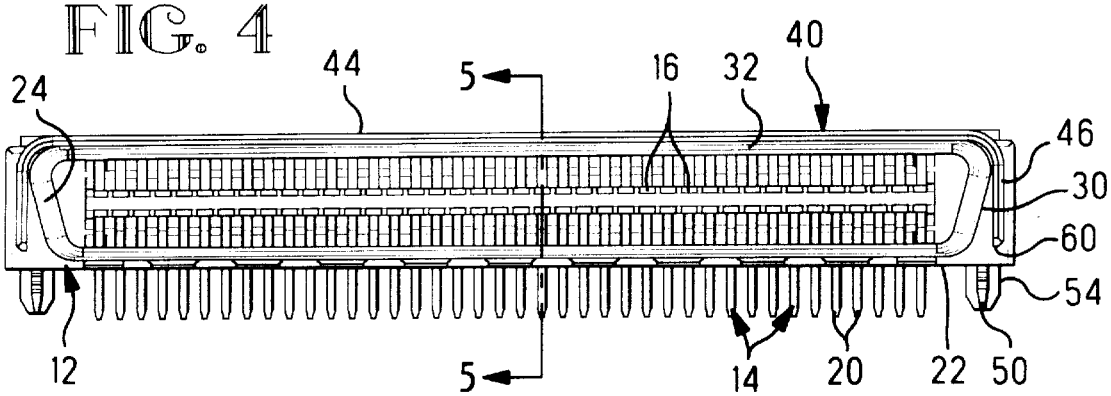

SHIELDS FOR ELECTRICAL CONNECTOR MATED PAIR

This application claims benefit of provisional application Ser. No. 60/044,584 filed Apr. 22, 1997.

FIELD OF THE INVENTION

The present invention relates to the field of electrical connectors and more particularly to connector shields.

BACKGROUND OF THE INVENTION

It is becoming more and more desirable to provide shielding around electrical connectors to protect signals transmitted therethrough from electromagnetic and radiofrequency interferences (EMI/RFI). A matable pair of such electrical connectors are now commercially available from AMP Incorporated, Harrisburg, Pa. as CHAMP connectors with Part Nos. 2-557100-1 and 2-557101-1 having eighty contact positions. The connectors are mountable at edges of respective circuit boards, each having arrays of terminals in respective insulative housings, with the terminals having right angle board-connecting tails extending rearwardly therefrom and complementary contact sections at respective mating interfaces.

It is desired to provide conductive shield members therefor. It is further desired that no modification be made to the mating interfaces to provide such shields.

SUMMARY OF THE INVENTION

A pair of shield members are complementary to each other and establish grounding connections therebetween upon connector mating, and each is electrically connected to ground circuits of the respective circuit board to which its respective connector is mounted. Each shield is securable to the housing of its respective connector in a manner that effectively shields the connector's mating interface, and that maintains its position precisely during repeated cycles of connector mating so that grounding connections with the other shield is consistently and assuredly attained. One of the shields includes an array of resilient sections such as spring fingers that engage the other shield at a plurality of locations.

Embodiments of the present invention will now be described by way of example with reference to the accompanying drawings.

BRIEF DESCRIPTION OF THE DRAWINGS

FIGS. 1 and 2 are isometric views of the connectors of the mated pair with shields, both mated to and unmated from each other;

FIG. 3 is an isometric view of one of the connectors of FIGS. 1 and 2 with the shield exploded therefrom;

FIG. 4 is an elevation view of the mating face of the connector of FIG. 3 having the shield in place;

DETAILED DESCRIPTION OF THE EMBODIMENTS

Figure 5:
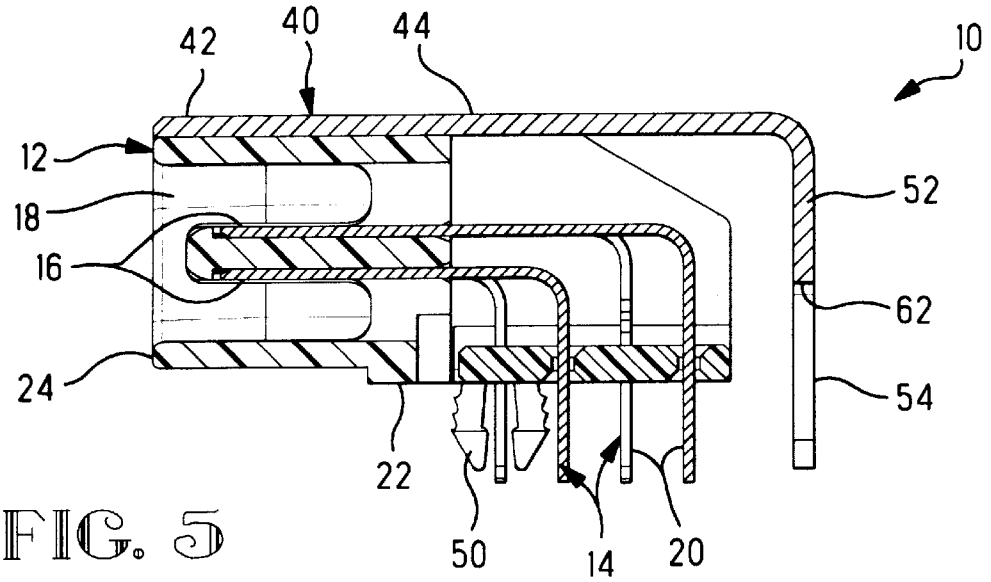
FIG. 5 is a longitudinal section view of the connector of FIG. 4 taken along lines 4—4 thereof.

Connectors 10 and 110 are a pair of connectors each mountable to a respective circuit board (not shown) and matable to each other at a mating interface. Each has an insulative housing 12,112 and a plurality of contacts 14,114, each extending from a first contact section 16,116 (FIGS. 5 and 10) along a mating face 18,118 to a second contact section 20,120 extending rearwardly and then at a right angle beyond a board-mount face 22,122 for electrical connection with a respective circuit of the circuit board. Housing 12 of connector 10 is seen to have a receptacle portion 24 shaped and dimensioned to be complementary to a plug portion 124 of housing 112 of connector 110, for receipt thereinto of the plug portion during connector mating.

Shields 40,140 are provided for each connector 10,110 that closely surround and shield its connector along all but the mating face and board-mount face thereof, and the shields 40,140 are complementary to each other at mating end portions 42,142 thereof in a manner establishing grounding connections therebetween, with leading edges 56,156 thereof preferably complementarily chamfered to prevent stubbing. Shields 40,140 are preferably stamped and formed of brass, for example, and bright tin-over-nickel plated, and include integral boardlocks 50,150, displacing the separate boardlock members of the commercially available unshielded connector for economy. Shields 40,140 are easily affixed to connectors 10,110 by being urged onto the top faces thereof.

Referring to FIGS. 3 to 5, shield 40 includes a top wall 44, side walls 46 and connector-retention sections 48 depending from side edges of top wall 44, board-lock sections 50 depending from connector-retention sections 48, a rear wall portion 52 depending from top wall 44 and at least one and preferably at least two spaced-apart rear legs 54 depending from rear wall portion 52. Top wall 44 and side walls 46 extend forwardly to leading shield edge 56 generally coinciding with the forwardmost portion of receptacle portion 24 of housing 12 and form the mating portion of shield 40. It is seen that connector-retention sections 48 are adapted to be received into respective slots 26 through flanges 28 of housing 12 and are in interference fit therewithin preferably through retention barbs 58. Board-lock sections 50 extend outwardly of slots 26 to depend below the board-mount face of the connector to be received into mounting holes of the circuit board to hold the connector thereto after mounting. Rear legs 54 will eventually be soldered in corresponding holes of the circuit board, and serve to stabilize the connector orientation during connector mating and unmating, optionally serving as grounding sections.

Referring to FIGS. 4 and 5, it is seen that side walls 46 of shield 40 depend vertically from top wall 44 along inwardly angled side walls 30 of receptacle portion 24 to free ends 60, while top wall 44 lies adjacent the outer surface of top wall 32 of receptacle portion 24. Rear wall portion 52 is seen to be spaced a selected distance rearwardly from rearwardmost second contact sections 20 and concluding in a lower edge 62 spaced upwardly from being aligned with board-mount face 22; such spacing is consistent with clearances such as 0.100 in considered desirable in telephonic signal transmission.

Figure 6:
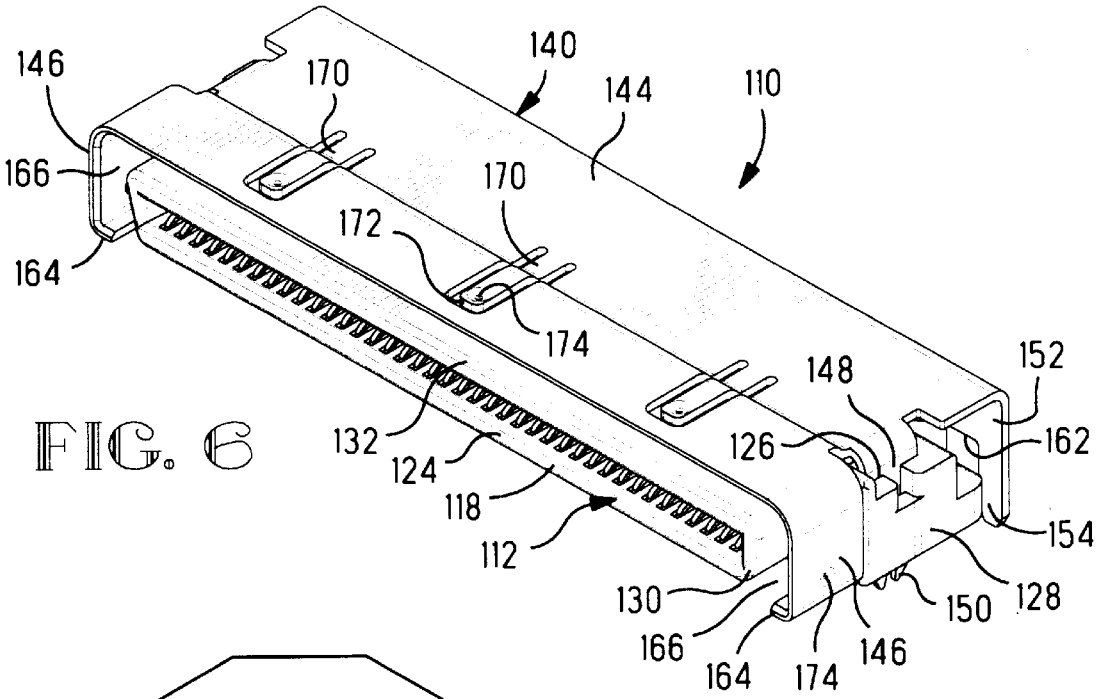
FIGS. 6 and 7 are isometric views of the second connector of FIGS. 1 and 2 with its shield assembled thereto and exploded, respectively.
Figure 7:
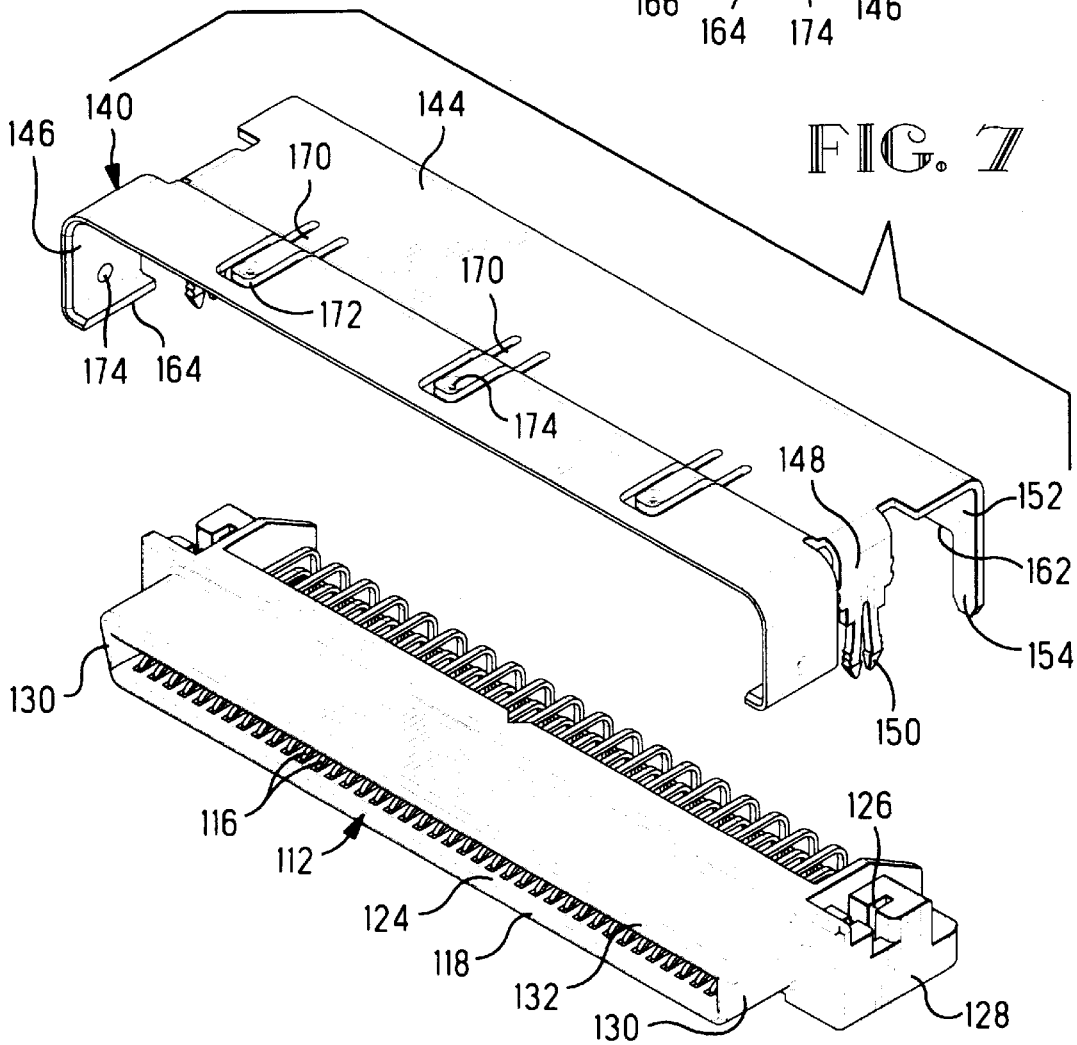
Figure 8:
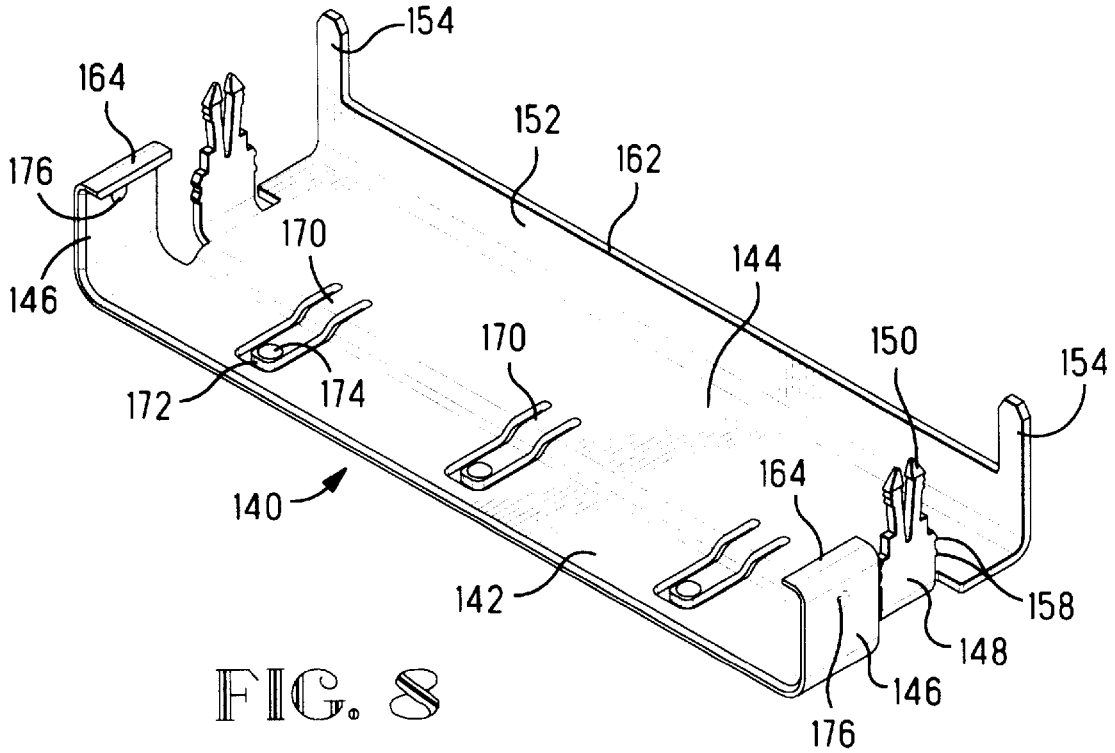
FIG. 8 is an isometric view of the bottom of the shield of FIGS. 6 and 7.
Figure 11:
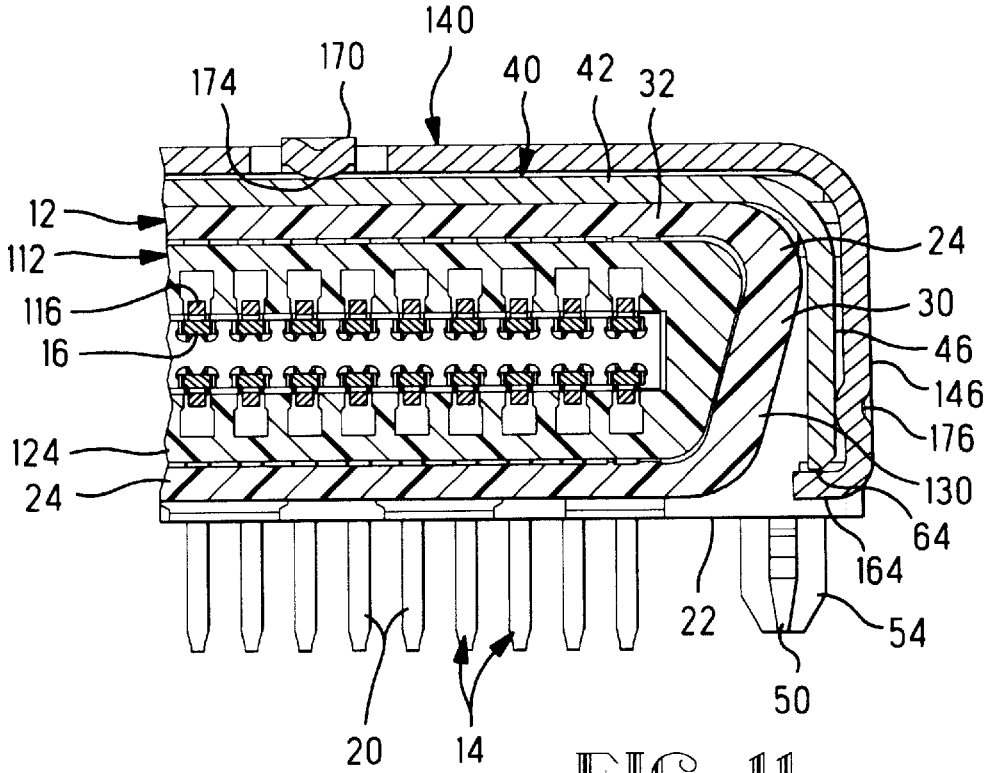
FIG. 11 is an enlarged view in cross-section of one end of the mated connector pair of FIG. 1 showing the mated engagement of the shields of the present invention.

With reference to FIGS. 6 to 8, shield member 140 includes a top wall 144, side walls 146, connector-retention sections 148 depending from top wall 144, board-lock sections 150 depending from retention sections 148, and rear wall portion 152 depending from top wall 144 with at least one and preferable at least two spaced-apart ground legs 154 depending from rear wall portion 152. Similarly to shield 40 of connector 10, top wall 144 and side walls 146 extend forwardly to leading shield edge 156 generally coinciding with the forwardmost portion of plug portion 124 of housing 112 and form the mating portion of shield 140. Connector-retention sections 148 are adapted to be received into respective slots 126 through flanges 128 of housing 112 and are in interference fit therewithin preferably through retention barbs 158. Board-lock sections 150 extend outwardly of slots 126 to depend below the board-mount face of the connector to be received into mounting holes of the circuit board to hold the connector thereto after mounting. As with shield 40 of connector 10, rear wall portion 152 is spaced a selected distance rearwardly from second contact sections 120 and concluding in a lower edge 162 spaced upwardly from being aligned with board-mount face 122.

Figure 9:
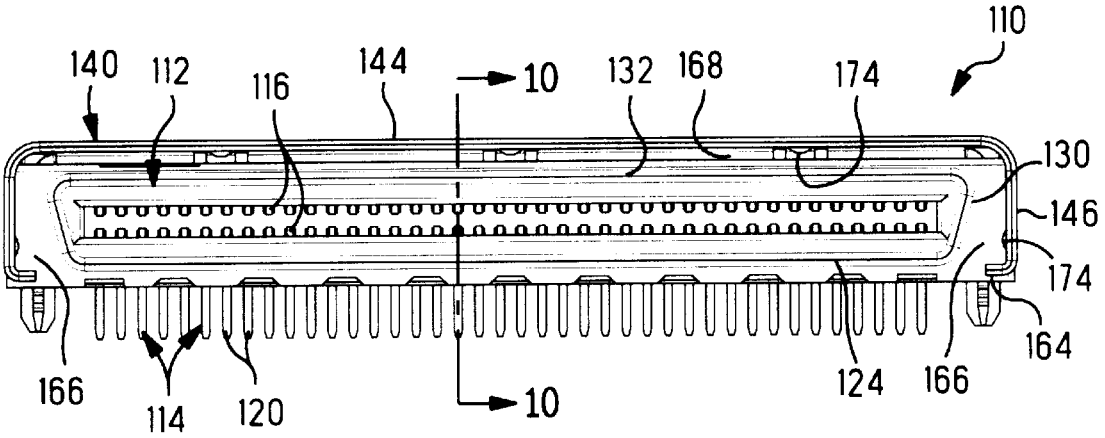
FIG. 9 is an elevation view of the mating face of the connector of FIGS. 6 and 7.
Figure 10:
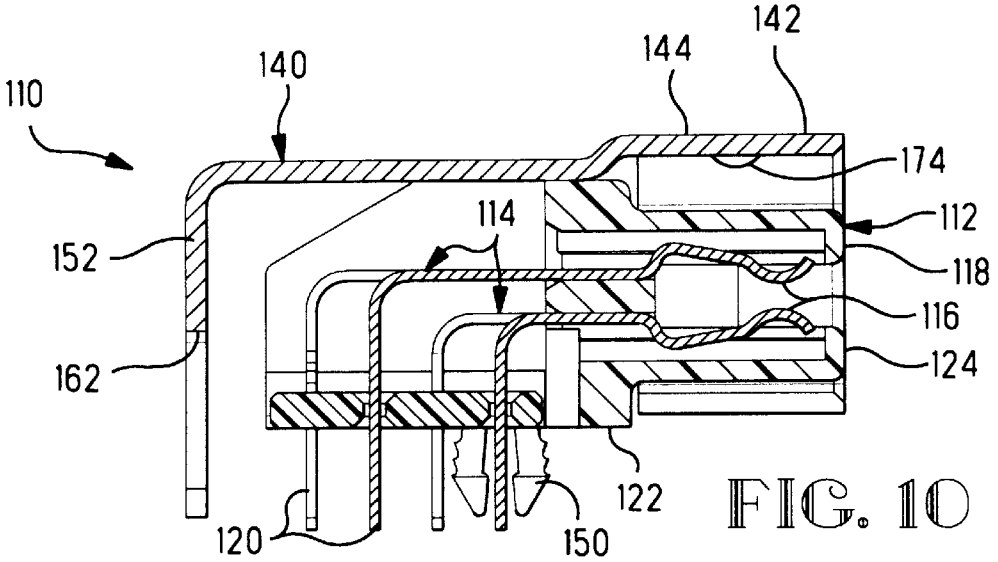
FIG. 10 is a longitudinal section view of the connector of FIG. 9 taken along lines 10—10 thereof.

In FIGS. 9 and 10 it is seen that side walls 146 depend vertically to free ends 164 that are preferably inturned. Side walls 146 are seen to be spaced laterally from outer surfaces of inwardly angled side walls 130 of plug portion 124 a selected distance, defining side gaps 166 therebetween just sufficiently to snugly receive therebetween side walls 30 of the receptacle portion 24 and shield side walls 46 of connector 10 during mating. Mating portion 142 of top shield wall 144 is spaced upwardly of the top surface of top wall 132 of plug portion 124, a selected distance to define a top gap 168 just sufficiently to snugly received therebetween both top wall 32 of the receptacle portion 24 and shield top wall 44 of connector 10, with top gap 168 in communication with side gaps 166.

Mating portion 142 of shield 140 includes a plurality of resilient sections to assuredly engage mating portion 42 of shield 40 upon connector mating. Preferably, an array of spring fingers 170 is defined along top wall 144 extending forwardly so that free ends 172 thereof are positioned along mating portion 142; free ends 172 preferably are embossed with dimples 174 extending into top gap 168 for assured engagement with top wall 44 of shield 40. Side walls 146 act as resilient sections and are deflectable outwardly, and preferably are also embossed with dimples 176 for engagement with side walls 46 of shield 40, with dimples 176 preferably staggered slightly forwardly of dimples 174 to reduce insertion forces during connector mating. Upwardly facing surfaces of inturned free ends 164 preferably are spaced from top wall dimples 174 incrementally less distance than the distance between side wall free ends 60 and the top surface of top wall 46 of shield 40. Free end 64 of side wall 46 will engage inturned free end 164 during mating so that were top wall 144 to be angled upwardly slightly for some reason, the engagement of the side wall free ends will pull the mating portion 142 into alignment with mating portion 42 of shield 40 so that assured grounding engagement will occur between the top wall 46 of shield 40 and dimples 174 of top wall 146 of shield 140 after repeated mating cycles.

Variations from the specific embodiments disclosed herein may occur that are within the spirit of the invention and the scope of the claims.

What is claimed is:

1. A matable electrical connector assembly comprising:

first and second connectors having first and second insulative housings and like pluralities of contacts each extending from first contact sections at a mating face of the respective connector to second contact sections at a board-mounting face, and first and second integral shields mountable to said first and second housings, each having top, side and rear shield walls for shielding top, side and rear faces of the respective connector except the mating face and board-mounting face;

said second housing including a plug portion adjacent said mating face thereof, and said first housing including a receptacle portion adjacent said mating face thereof adapted to receive thereinto said plug portion of said second housing;

said first shield having a mating portion adjacent said mating face with said top wall of said first shield lying adjacent a top wall of said receptacle portion of said first housing and side walls of said first shield depending vertically from said top shield wall adjacent side walls of said receptacle portion, and said second shield having a mating portion adjacent said mating face with said top wall of said second shield spaced from said a top wall of said plug portion of said second housing and with said side walls of said second shield depending vertically from said top shield wall along and spaced from side walls of said plug portion, said second shield thereby defining a gap of said second connector along said side walls and top wall of said plug portion of said second housing; and at least said top wall of said second shield including resilient sections having embossments protruding into said gap, whereby said first housing side walls and top wall and said first shield mating portion are received into said gap of said second connector for grounding engagement by said resilient sections with an outer surface of said first shield when said gap is dimensioned to snugly receive thereinto said first housing side walls and top wall and said first shield mating portion.

2. The connector assembly as set forth in claim 1 wherein said resilient sections of said second shield are spring arms.

3. The connector assembly as set forth in claim 1 wherein said side walls of said second shield include inwardly directed embossments and define resilient sections.

4. The connector assembly as set forth in claim 1 wherein said side walls of said second shield conclude in inwardly directed free ends having upwardly facing surfaces spaced from said embossments of said second shield top wall a distance incrementally less than the distance between said side walls of said first shield from lower end edges of said first shield side walls and an upper surface of said first shield top wall, whereby receipt of said first shield side walls alongside inner surfaces of said second shield side walls necessitates engagement of said first shield side wall lower edges with said inwardly directed free ends of said second shield side walls and adjust the alignment of said second shield with said first shield during initial stages of connector mating, to assure grounding engagement of said second shield resilient sections with said first shield top wall.

5. The connector assembly as set forth in claim 1 wherein said first and second shields include fastening sections depending from side edges of said top walls thereof for receipt into slots of said first and second housings in interference fit.

6. The connector assembly as set forth in claim 5 wherein boardlock sections depend from said fastening sections of said first and second shields and extend below said board-mounting faces of said first and second housings after passing through said slots thereof.

7. The connector assembly as set forth in claim 1 wherein stabilizing legs depend from said rear walls of said first and second shields and extend below said board-mounting faces of said first and second housings for receipt into corresponding holes of a circuit board.

* * * * *